US007841326B2

(12) United States Patent
Karrelmeyer et al.

(10) Patent No.: US 7,841,326 B2
(45) Date of Patent: Nov. 30, 2010

(54) METHOD FOR OPERATING AN INTERNAL COMBUSTION ENGINE

(75) Inventors: Roland Karrelmeyer, Bietigheim-Bissingen (DE); Christina Sauer, Benningen (DE); Wolfgang Fischer, Gerlingen (DE); Juergen Haering, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/005,974

(22) Filed: Dec. 27, 2007

(65) Prior Publication Data

US 2008/0156305 A1 Jul. 3, 2008

(30) Foreign Application Priority Data

Dec. 27, 2006 (DE) ..... 10 2006 061 560

(51) Int. Cl.
*F02D 41/00* (2006.01)

(52) U.S. Cl. ..... 123/679; 123/672

(58) Field of Classification Search ..... 123/406.47, 123/672, 677, 679
See application file for complete search history.

(56) References Cited

U.S. PATENT DOCUMENTS 5,797,370 A * 8/1998 Kimura et al. ..... 123/478
6,058,906 A * 5/2000 Yoshino ..... 123/295
6,109,225 A * 8/2000 Ogita et al. ..... 123/90.15
6,267,095 B1 * 7/2001 Ikeda et al. ..... 123/295
6,386,156 B1 * 5/2002 Stockhausen et al. .... 123/90.15
6,405,694 B2 * 6/2002 Sato ..... 123/90.15
6,701,903 B1 * 3/2004 Collins et al. ..... 123/568.14
6,999,864 B2 * 2/2006 Iizuka et al. ..... 701/103
7,040,304 B2 * 5/2006 Kassner ..... 123/565
7,073,485 B2 * 7/2006 Truscott et al. ..... 123/406.22
7,191,050 B2 * 3/2007 Machida ..... 701/103
7,234,446 B2 * 6/2007 Toyoda ..... 123/406.14
7,363,911 B2 * 4/2008 Brehob ..... 123/406.47
7,513,228 B2 * 4/2009 Hiyoshi et al. ..... 123/90.16
2005/0235952 A1 * 10/2005 Kuzuyama et al. ..... 123/305
2007/0271907 A1 * 11/2007 Yamana et al. ..... 60/285
2008/0288159 A1 * 11/2008 Eser et al. ..... 701/104

* cited by examiner

*Primary Examiner*—Stephen K Cronin
*Assistant Examiner*—David Hamaoui
(74) *Attorney, Agent, or Firm*—Kenyon & Kenyon LLP

(57) ABSTRACT

A method for operating an internal combustion engine working according to the Otto principle, in which fuel, particularly gasoline, is injected directly into a combustion chamber and is inflamed by self-ignition. A characteristic quantity characterizing the stability of combustion of an air/fuel mixture located in the combustion chamber is ascertained, and, as a function of the characteristic quantity, a residual gas proportion in the cylinder associated with the combustion chamber is set, in particular minimized, the residual gas proportion being reduced, preferably iteratively, as long as the characteristic quantity does not fall below a specifiable stability boundary.

15 Claims, 2 Drawing Sheets

METHOD FOR OPERATING AN INTERNAL COMBUSTION ENGINE

FIELD OF THE INVENTION

The present invention relates to a method for operating an internal combustion engine. The present invention also relates to a computer program and a control unit for an internal combustion engine.

BACKGROUND INFORMATION

Internal combustion engines having operating types also designated as HCCI (homogeneous charge compression ignition) are known, in which fuel is injected directly into a combustion chamber and ignites itself comparable to the Diesel principle. The HCCI combustion methods are used in internal combustion engines otherwise operated using externally supplied ignition, especially because of their high potential for reduction in fuel usage and reduction in emissions. Since the stability of HCCI combustion methods is generally very sensitive with respect to changed boundary conditions, such as environmental temperature, variances in a valve system of the internal combustion engine, environmental pressure, aging of components of the internal combustion engine and the like, usual HCCI combustion methods provide using a relatively large quantity of hot residual gas for a cylinder charge, this gas being introduced into the combustion chamber by way of internal or external exhaust-gas recirculation by an appropriate design and activation of gas exchange valves. In the known HCCI combustion methods, this achieves a sufficiently great cylinder temperature, which has a positive effect on the stability of the combustion process, and makes the combustion or ignition possible in the first place. Because of the relatively large proportion of residual gas of the cylinder charge in the usual HCCI combustion methods, the fresh air proportion in the corresponding cylinder is reduced, whereby the calorific properties of the air/fuel mixture, present in the combustion chamber of the cylinder, deteriorate, so that the fuel usage of the internal combustion engine is also increased.

SUMMARY OF THE INVENTION

Accordingly, it is an object of the present invention to improve a method of the type mentioned above in such a way that it makes possible a lower fuel usage without impairment of the stability of the combustion.

This object is attained by ascertaining the characteristic quantity that characterizes the stability of the combustion of an air/fuel mixture located in the combustion chamber and by setting and especially minimizing the residual gas proportion in the cylinder associated with the combustion chamber, the residual gas proportion being reduced, preferably iteratively, as long as the characteristic quantity does not fall below a specifiable stability boundary.

According to the present invention, the formation of the characteristic quantity that characterizes the combustion, or rather its stability, makes possible a targeted optimization of parameters influencing the air/fuel ratio, particularly an optimization of the residual gas proportion, preferably its minimization, without impairing the stability of combustion at the same time. Using this method, the fuel consumption of the internal combustion engine can be optimized in a particularly efficient manner, even in an operating type that is based on HCCI combustion methods. An especially efficient reduction in fuel consumption is advantageously achieved, according to the present invention, by reducing the residual gas proportion, as long as the characteristic quantity does not fall below a specifiable stability boundary.

A characteristic quantity, that particularly precisely characterizes the stability of combustion, is obtained as a result of an advantageous variant of the method according to the present invention if the characteristic quantity is ascertained as a function of the energy delivered by the internal combustion engine, especially per working cycle, and especially as a function of a variance of the energy delivered and/or as a function of the variance of the energy delivered referred to an average value of the energy delivered, formed over a number of work cycles.

Alternatively, or in supplement, the characteristic quantity can advantageously also be ascertained as a function of a combustion position, particularly as a function of a variance of the combustion position.

It is also advantageous to use the quotient of energy delivered by the internal combustion engine and the energy expected to be delivered based on the injected fuel quantity as the characteristic quantity characterizing the stability of combustion, or rather for the formation of the characteristic quantity.

Particularly meaningful values for the characteristic quantity of the stability of combustion can also be obtained, according to the present invention, by ascertaining the characteristic quantity as a function of preceding, recorded incomplete combustions and/or misfires, especially as a function of their number.

It is advantageously possible, according to the present invention, to form the characteristic quantity as a function of a plurality of sensor signals or a combination of them, especially as a function of a signal of an in-cylinder pressure sensor and/or an ion current sensor and/or a knock sensor and/or a crank angle sensor.

As was mentioned before, an especially efficient reduction in fuel consumption is advantageously achieved, according to the present invention, by reducing the residual gas proportion, as long as the characteristic quantity does not fall below a specifiable stability boundary. According to the present invention, the reduction in the residual gas proportion advantageously takes place in an iterative method, in which the residual gas proportion is reduced in a plurality of cycles by a specifiable increment, as long as the characteristic quantity has not yet reached the specifiable stability boundary or hasn't already fallen below it.

Accordingly, in response to reaching and falling below the stability boundary, the residual gas proportion can in turn be increased by a specifiable increment, in order to ensure sufficient stability of combustion.

According to the present invention, the increment for raising or lowering the residual gas proportion is formed as a function of the characteristic quantity itself and/or as a function of additional operating variables of the internal combustion engine, whereby a particularly precise approximation of the residual gas proportion to a minimally possible value is enabled, particularly also as a function of an actually recorded operating state of the internal combustion engine.

The residual gas proportion that is to be set, according to the present invention, is preferably set via a corresponding activation of gas exchange valves of the internal combustion engine. For instance, in a valve strategy having negative valve overlap, the residual gas proportion of the cylinder charge can be increased by the following interventions:

The control times for the closing of an exhaust valve and the opening of an intake valve are shifted symmetrically in the direction of the upper dead center in the gas exchange cycle (GWOT), the position in time, but not the duration of the opening of the exhaust valve is shifted in the direction GWOT while simultaneously maintaining the control times for the intake valve.

Besides setting the residual gas proportion, it is also conceivable to set a fuel quantity to be injected into the combustion chamber as a function of the characteristic quantity, or, in general, to set further parameters of the internal combustion engine known to one skilled in the art, which influence the air/fuel ratio, especially parameters of the fuel system. When it comes to minimizing the fuel usage, the parameters are changed, analogously to the setting of the residual gas proportion, until the characteristic quantity according to the present invention reaches an appropriate stability boundary. A multidimensional optimization, while simultaneously taking into consideration several parameters, is likewise conceivable.

Of particular importance is the implementation of the method according to the present invention in the form of a computer program that is able to be run on a computer or a processing unit, and is suitable for executing the method. The computer program may, for instance, be stored on an electronic storage medium, the storage medium, on its part, being included, for example, in the control unit.

DETAILED DESCRIPTION

Figure 1:
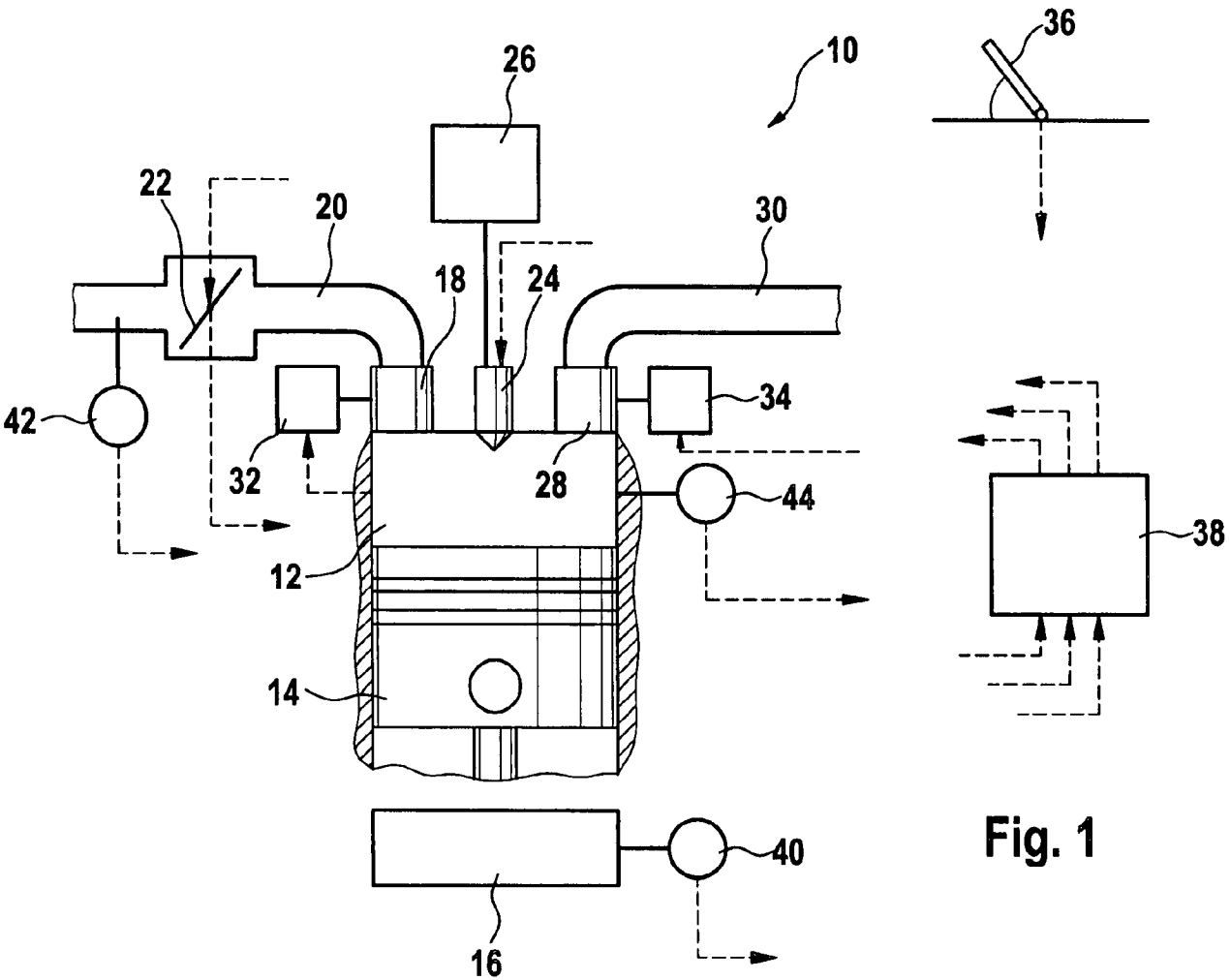
FIG. 1 shows a schematic representation of an internal combustion engine according to the present invention.

In FIG. 1, an internal combustion engine in its entirety bears reference numeral 10. It is preferably used for driving a motor vehicle that is not shown. Internal combustion engine 10 includes a plurality of cylinders, of which only one is shown in FIG. 1 in exemplary form, with its combustion chamber 12 and piston 14. Piston 14 is connected to a crankshaft 16. Combustion air arrives in combustion chamber 12 via an intake valve 18 and an intake port 20.

Intake port 20 has a throttle valve 22 for setting a fresh air mass flow which is supplied to combustion chamber 12 via intake port 20.

Fuel is injected directly into combustion chamber 12 by an injector 24 which, on its part, is supplied with fuel by a high-pressure fuel system 26. Compared to a manifold injection, a direct injection of fuel into combustion chamber 12 makes possible a targeted influencing of HCCI-based operating types of internal combustion engine 10.

Hot combustion exhaust gases are carried off from combustion chamber 12 via an exhaust valve 28 in an exhaust port 30. Intake valve 18 is operated by an adjustable camshaft 32 and exhaust valve 28 is operated by an adjustable camshaft 34.

As an alternative to adjustable camshafts 32, 34, one may also use a fully variable valve control (not shown) in internal combustion engine 10, in order to be able to utilize the maximum number of degrees of freedom in influencing the gas exchange process.

A user of internal combustion engine 10 issues a torque request by operating an accelerator 36. The operation of internal combustion engine 10 is controlled and regulated by a control and regulation device 38, designated henceforth briefly as control unit, which processes the signals supplied by accelerator 36, among other things. In addition, control unit 38 receives the signals of a crank angle sensor or rotary speed sensor 40, which records a crank angle or the rotary speed of crankshaft 16, a hot-film air mass (HFM) sensor 42 which records the air mass flowing through intake port 20, and signals from an in-cylinder pressure sensor 44 which records the pressure present in combustion chamber 12.

Among other things, injector 24 and throttle valve 22 are activated for setting an operating point of internal combustion engine 10. The settings of intake camshaft 32 and exhaust camshaft 34 or the state of a fully variable valve control are also influenced by appropriate signals from control unit 38.

In connection with the present invention, since only the homogeneous self igniting operation (HCCI) of internal combustion engine 10 is of interest, a spark plug, required for the further operating types of internal combustion engine 10, that are based on the principle of externally supplied ignition, are not illustrated here.

In the HCCI combustion method examined according to the present invention, the fuel injected by injector 24 into combustion chamber 12 is inflamed by itself based on a temperature increase of the air/fuel mixture enclosed in combustion chamber 12, which comes about in response to its compression during the compression stroke of the cylinder.

Figure 2:
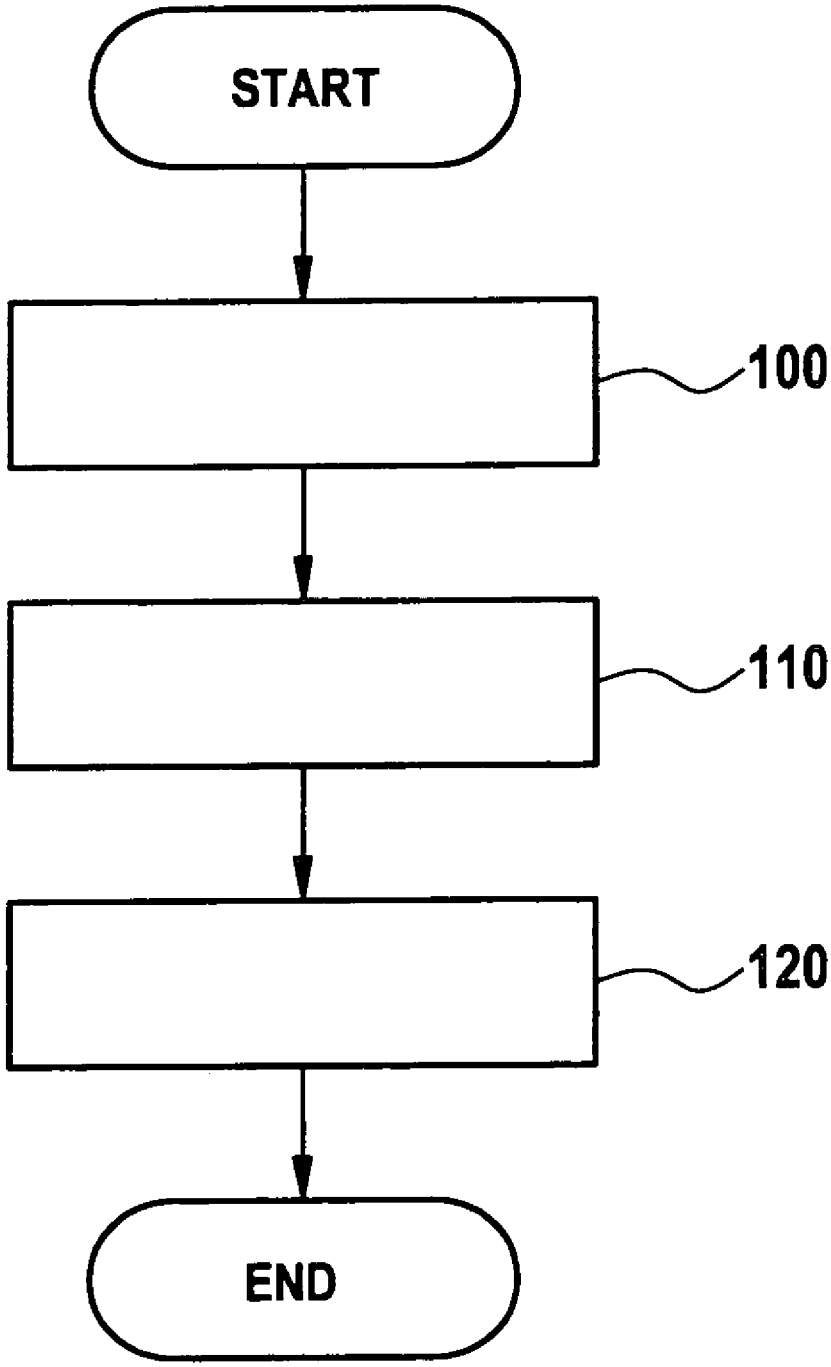
FIG. 2 shows a simplified flow chart of a first specific embodiment of the method According to the present invention.

In order to make possible a particularly fuel-saving operation of internal combustion engine 10, the method described with reference to the flow chart illustrated in FIG. 2 is carried out, in which a characteristic quantity, that characterizes the stability of combustion of the air/fuel mixture located in combustion chamber 12, is ascertained, and control of the operation of internal combustion engine 10 is carried out as a function of this characteristic quantity.

In a first step 100, the characteristic quantity described is ascertained, according to the present invention.

The characteristic quantity is preferably ascertained as a function of the energy delivered by internal combustion engine 10, particularly a variance of the energy delivered and/or a variance with reference to the average value of the energy delivered being examined so as to be able to draw conclusions on the change with time of the energy delivered by internal combustion engine 10, and thus the stability of combustion in combustion chamber 12. An additional criterion that can be used, either by itself or in combination with the above described energy delivered by internal combustion engine 10 to form the characteristic quantity according to the present invention, is the combustion position or its variance. Data concerning the combustion position can advantageously be obtained particularly from a crank angle signal or a rotary speed signal which indicates the rotary speed of crankshaft 16 of internal combustion engine 10, or they can be obtained directly from a curve over time of the in-cylinder pressure, as it is obtained by in-cylinder pressure sensor 44 (FIG. 1).

It can further be provided, according to the present invention, that the characteristic quantity is ascertained as a function of the quotient of the energy delivered by internal combustion engine 10 and of the energy expected to be delivered based on the injected fuel quantity.

In addition, it is also possible to ascertain the characteristic quantity as a function of previously recorded incomplete combustions and/or misfires, especially as a function of their number.

A combination of the above described methods for forming the characteristic quantity is likewise conceivable.

Besides the evaluation of signals from in-cylinder pressure sensor 44 and/or crank angle sensor or rotary speed sensor 40, in particular, signals from ion current sensors and/or knock sensors or the like, that are not shown in FIG. 1, can also be evaluated.

The method according to the present invention provides a preferably iterative reduction in the residual gas proportion present in combustion chamber 12, in order to set as lean as possible an operation and with that a fuel saving operation of internal combustion engine 10. Within the scope of this iterative reduction in the residual gas proportion, and starting from the usual HCCI operation of internal combustion engine 10, the residual gas proportion is reduced stepwise until the characteristic quantity, in this example ascertained in step 100 (FIG. 2), has reached a specifiable stability boundary.

After the characteristic quantity has been ascertained first of all in step 100 of the method according to the present invention, an evaluation of the characteristic quantity is made in following step 110, of the method according to the present invention, particularly with respect to the reaching or the falling below the specifiable stability boundary. Insofar as one may conclude, from the characteristic quantity ascertained in step 100, that a further reduction in the residual gas proportion is possible without impairing the stability in the operation of internal combustion engine 10, a corresponding reduction in the residual gas proportion by a specifiable increment is subsequently undertaken in method step 120. The reduction in the residual gas proportion preferably takes place for a subsequent power cycle of the cylinder of internal combustion engine 10 shown in FIG. 1, the increment for reducing the residual gas proportion being preferably selected as a function of the characteristic quantity and/or as a function of further operating variables of internal combustion engine 10. This advantageously makes possible a particularly precise approximation of the actually set residual gas proportion to a residual gas proportion required at a minimum for a stable operation of internal combustion engine 10, whereby, among other things, the robustness of the method according to the present invention is advantageously increased.

To the extent that the evaluation of the characteristic quantity in step 110 indicates that the characteristic quantity has already reached or has even fallen below the specifiable stability boundary, no further reduction in the residual gas proportion is undertaken, according to the present invention. Rather, a residual gas proportion can be advantageously increased for subsequent power cycles of the cylinder, so as to produce again and ensure stable operation of internal combustion engine 10.

The setting of the residual gas proportion takes place, in a manner known to one skilled in the art, by appropriate control of intake camshaft 32 and exhaust camshaft 34, or an alternatively usable fully variable valve control system by control unit 38 of internal combustion engine 10.

In a valve control strategy having, for instance, negative valve overlap, the residual gas proportion can be reduced particularly by the following interventions:

The closing instant of exhaust valve 28 and the opening time of intake valve 18 are shifted symmetrically in the direction of upper dead center in the gas exchange cycle (GWOT), the position in time, but not the duration, of the opening of exhaust valve 28 is shifted in direction GWOT, while the control times for intake valve 18 are maintained.

The setting of a higher residual gas proportion can accordingly be effected by an inverse procedure or by further measures known to one skilled in the art.

The increments used for the reduction or the increase in the residual gas proportion may also particularly advantageously be selected as a function of a deviation of the characteristic quantity from the specifiable stability boundary, which yields an even more precise setting of a fuel-optimized and yet stable operation of internal combustion engine 10.

Since the operating method according to the present invention, and especially the modification of the residual gas proportion undertaken in it, in general also change other features of the combustion, such as the combustion position and the efficiency, the method according to the present invention can advantageously be combined with a corresponding control method or regulating method, for the regulation of the combustion position and/or the energy delivered by internal combustion engine 10.

In general, while using the characteristic quantity according to the present invention, all the methods known to one skilled in the art for setting the residual gas proportion in the cylinder charge, can be used in order to ensure a fuel-optimizing and yet stable operation of internal combustion engine 10.

Besides the setting of the residual gas proportion described above, it is also conceivable to set a fuel quantity to be injected into combustion chamber 12 as a function of the characteristic quantity, or, in general, to set further parameters of internal combustion engine 10 known to one skilled in the art, which influence the air/fuel ratio. When it comes to minimizing the fuel usage, the parameters are changed, analogously to the setting of the residual gas proportion, until the characteristic quantity according to the present invention reaches an appropriate stability boundary.

In order to carry out the method according to the present invention described above, control unit 38 can have an appropriate processing unit, such as a microcontroller or a digital signal processor that has an electronic storage medium assigned to it, which includes a computer program for implementing the method according to the present invention.

What is claimed is:

1. A method for operating an internal combustion engine working according to the Otto principle, the method comprising:

injecting fuel directly into a combustion chamber for inflaming the fuel by self-ignition;

ascertaining a characteristic quantity characterizing a stability of combustion of an air/fuel mixture located in the combustion chamber, wherein a stable range for operation corresponding to the characteristic quantity has a lower stability boundary; and setting, as a function of the characteristic quantity, a residual gas proportion in a cylinder associated with the combustion chamber, the residual gas proportion being iteratively reduced as long as the characteristic quantity does not fall below the lower stability boundary.

2. The method according to claim 1, wherein the fuel is gasoline.

3. The method according to claim 1, wherein the residual gas proportion is minimized.

4. The method according to claim 1, wherein the characteristic quantity is ascertained as a function of an energy delivered by the internal combustion engine, as a function of at least one of a variance of the energy delivered and the variance of the energy delivered with respect to an average value of the energy delivered.

5. The method according to claim 1, wherein the characteristic quantity is ascertained as a function of a variance of a combustion position.

6. The method according to claim 1, wherein the characteristic quantity is ascertained as a function of a quotient of an energy delivered by the internal combustion engine and of an energy expected to be delivered based on an injected fuel quantity.

7. The method according to claim 1, wherein the characteristic quantity is ascertained as a function of at least one of (a) previously recorded incomplete combustions and (b) misfires, as a function of their number.

8. The method according to claim 1, wherein the characteristic quantity is ascertained as the function of at least one of (a) a signal of an in-cylinder pressure sensor, (b) an ion current sensor, (c) a knock sensor and (d) a crank angle sensor.

9. The method according to claim 1, further comprising setting at least one additional air/fuel ratio-influencing parameter of a fuel system.

10. The method according to claim 1, wherein the residual gas proportion is increased as soon as the characteristic quantity falls below a specifiable stability boundary.

11. The method according to claim 1, wherein the residual gas proportion is changed by an increment that is a function of at least one of (a) the characteristic quantity and (b) further operating variables of the internal combustion engine.

12. The method according to claim 1, wherein the residual gas proportion is set by a control of gas exchange valves of the internal combustion engine.

13. A computer-readable medium having a computer program which is executable by a processor, comprising:

a computer program arrangement having program code for operating an internal combustion engine working according to the Otto principle by performing the following:

injecting fuel directly into a combustion chamber for inflaming the fuel by self-ignition;

ascertaining a characteristic quantity characterizing a stability of combustion of an air/fuel mixture located in the combustion chamber, wherein a stable range for operation corresponding to the characteristic quantity has a lower stability boundary; and setting, as a function of the characteristic quantity, a residual gas proportion in a cylinder associated with the combustion chamber, the residual gas proportion being iteratively reduced as long as the characteristic quantity does not fall below the lower stability boundary.

14. A control unit for operating an internal combustion engine working according to the Otto principle, comprising:

an injecting arrangement for injecting fuel directly into a combustion chamber for inflaming the fuel by self-ignition;

a determining arrangement for ascertaining a characteristic quantity characterizing a stability of combustion of an air/fuel mixture located in the combustion chamber, wherein a stable range for operation corresponding to the characteristic quantity has a lower stability boundary; and a setting arrangement for setting, as a function of the characteristic quantity, a residual gas proportion in a cylinder associated with the combustion chamber, the residual gas proportion being iteratively reduced as long as the characteristic quantity does not fall below the lower stability boundary.

15. The method according to claim 1, wherein the residual gas proportion is reduced in a plurality of cycles by a specific increment.

* * * * *